US006640443B2

(12) United States Patent
Hüsges et al.

(10) Patent No.: US 6,640,443 B2
(45) Date of Patent: Nov. 4, 2003

(54) MANUALLY GUIDED IMPLEMENT

(75) Inventors: Markus Hüsges, Bad Wiessee (DE); Jochen Kramer, Waiblingen (DE)

(73) Assignee: Andreas Stihl AG & Co.

( * ) Notice: Subject to any disclaimer, the term of this patent is extended or adjusted under 35 U.S.C. 154(b) by 0 days.

(21) Appl. No.: 09/849,153

(22) Filed: May 4, 2001

(65) Prior Publication Data

US 2001/0039736 A1 Nov. 15, 2001

(30) Foreign Application Priority Data

May 4, 2000 (DE) ..... 100 21 707

(51) Int. Cl.[7] ..... F01P 1/02; F02B 63/02
(52) U.S. Cl. ..... 30/276; 123/41.7
(58) Field of Search ..... 30/276, 347; 123/41.65, 123/41.69, 41.7

(56) References Cited

U.S. PATENT DOCUMENTS 5,363,815 A * 11/1994 Pretzsch et al. ..... 123/41.7

FOREIGN PATENT DOCUMENTS

DE 196 18 669 A1 11/1997
DE 197 52 798 A1 6/1999

* cited by examiner

*Primary Examiner*—Douglas D. Watts
(74) *Attorney, Agent, or Firm*—R W Becker & Associates; R W Becker

(57) ABSTRACT

A manually guided implement having an air-cooled internal combustion engine for driving a tool is provided. The engine is disposed in a housing, with cooling air being conveyed by a fan wheel that is fixedly held on the crankshaft of the engine and that is accommodated in a cooling air spiral case that is open toward the engine. Formed in the housing is an air inlet via which ambient air can be drawn into the cooling air spiral case. A base of the spiral case is disposed between the fan wheel and the engine and is provided with a second cooling air inlet that provides communication between the interior of the housing and portions of the cooling air spiral case that convey cooling air.

14 Claims, 8 Drawing Sheets

MANUALLY GUIDED IMPLEMENT

BACKGROUND OF THE INVENTION

The present invention relates to a manually guided implement, such as power chain saws, brush cutters and the like, having an air-cooled internal combustion engine for driving a tool. The engine is disposed within an implement housing, and a fan wheel is provided that is fixedly held on a crankshaft of the internal combustion engine and is accommodated in a cooling air spiral case that is open toward the engine. Formed in the implement housing is an air inlet through which ambient air can be drawn into the cooling air spiral case and can be conveyed to the internal combustion engine.

With heretofore known implements, the tool is driven by an internal combustion engine that is disposed within an implement housing. To convey the cooling air for the internal combustion engine, a fan wheel is provided that is fixedly held on a crankshaft of the internal combustion engine and rotates in a cooling air spiral case that is open toward the internal combustion engine.

DE 197 52 798 A1 discloses an implement according to which, during operation of the engine, the rotating fan wheel draws in ambient air through a fan cover into the cooling air spiral case in the implement housing. From the cooling air spiral case the cooling air stream passes to the cylinder of the internal combustion engine and is discharged from the implement housing via outlet slots. An opening is provided in the base of the cooling air spiral case and an air for combustion channel to an air filter of the engine is connected to the opening. In this way, a partial stream is branched off from the cooling air stream and is conveyed as air for combustion to the internal combustion engine.

DE 196 18 669 A1 discloses a manually guided implement having an air for combustion inlet opening disposed in the base of the cooling air spiral case, whereby air for combustion is conveyed out of the interior of the implement housing through the inlet opening, and is conveyed to the engine in an air for combustion channel that follows in the direction of flow.

With manually guided implements, the implement housing is to be small and compact, as a result of which increased temperatures can occur in the compact internal combustion engine. Especially when four-stroke engines are utilized in the housings of implements, considerably higher temperatures result despite external air cooling.

It is therefore an object of the present invention to further develop an implement of the aforementioned general type in such a way that the cooling of the internal combustion engine is improved.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
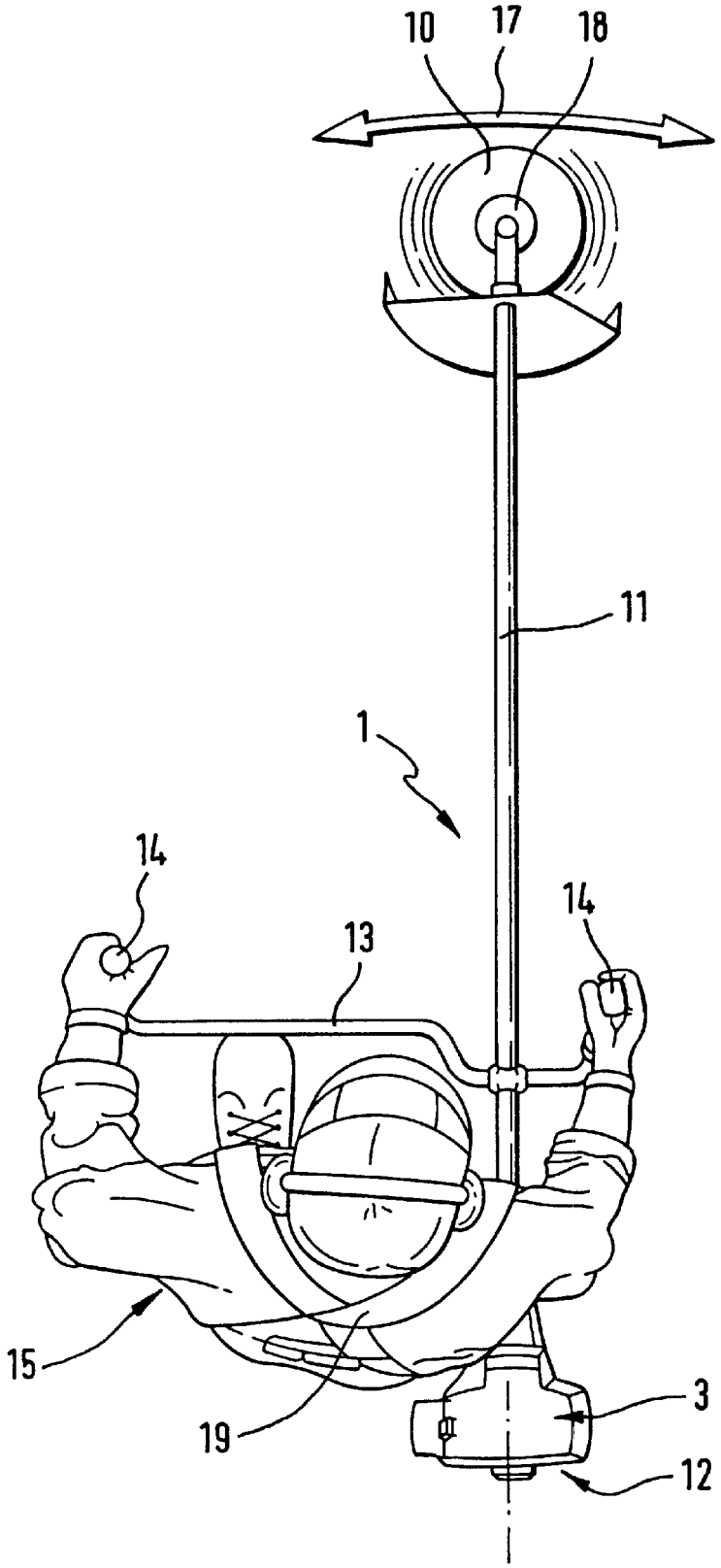
FIG. 1 is a top view of a manually guided cutting implement.

The manually guided implement of the present invention is characterized primarily in that a second cooling air inlet is formed in a base of the cooling air spiral case that is disposed between the fan wheel and the internal combustion engine, wherein such second air inlet provides communication between the interior of the implement housing and portions of the cooling air spiral case that convey cooling air.

Pursuant to the present invention, a second cooling air inlet is formed in the base of the cooling air spiral case and provides communication between a portion of the interior of the implement housing and portions of the cooling air spiral case that convey cooling air. As a result, two cooling air streams are conveyed independently of one another, and are blown or discharged in common against the engine block for cooling the engine. The cold ambient air, as a portion of the cooling air conveyed to the engine, keeps the temperature of the engine in the region of the cylinder head low. As a consequence of the second cooling air inlet in the base of the cooling air spiral case, air that is heated by the engine is withdrawn from the interior space of the implement housing, so that an air movement is also effected in spaces of the implement housing that are remote from the cylinder. This therefore counteracts the heating-up of the air in the interior of the housing in the vicinity of the internal combustion engine and of the surrounding components. The second cooling air inlet in the base of the cooling air spiral case is expediently disposed on that side of the crankshaft remote from the cylinder, so that air is drawn off from the space beneath the crankcase of the internal combustion engine.

To convey the cooling air streams in axially opposed directions of the fan wheel, the fan wheel is expediently provided on both end faces with a respective suction ring of vanes. These rings of vanes are advantageously separated from one another on the fan wheel by a radially extending partition, thereby increasing the suction effect on both end faces of the fan wheel. The first suction ring of vanes that faces away from the internal combustion engine is advantageously provided with a greater axial width than is the inwardly disposed, second suction ring of vanes that faces the internal combustion engine. The greater proportion of the cooling air stream that is conveyed to the internal combustion engine is thus drawn in by the first suction ring of vanes from the air surrounding the implement.

If the fan wheel is disposed on a driver of the crankshaft that drives the tool, the drawn-in cooling air stream passes over and cools a clutch that cooperates with the driver. Especially in a slippage operation of the clutch, this ensures an effective cooling of the clutch. The cooling air spiral case is covered by a fan cover that is held on the implement housing and in which inlet openings are provided for air intake; the ambient air is drawn into the cooling air spiral case via these inlet openings. The fan cover expediently has a top-shaped configuration, and the interior thereof accommodates the clutch that cooperates with the crankshaft. The inlet openings are disposed on the periphery of the fan cover approximately at the level of the clutch.

In a preferred specific embodiment of the present invention, that portion of the interior of the implement housing that is formed between the crankcase of the internal combustion engine and the implement housing is in flow communication with one or more second inlet openings in the implement housing, whereby the flow path from the second inlet openings in the housing to the second cooling air inlet in the base of the cooling air spiral case is guided in such a way that the conveyed cooling air can pass over components in the implement housing that are to be kept cool. The second inlet openings are expediently disposed on that side of the internal combustion engine that faces away from the cooling air spiral case, so that cooling air can be conveyed from a different portion of the ambient air about the implement than is the case for the first cooling air inlet on the drive side of the internal combustion engine.

The flow path to the second cooling air inlet in the base of the cooling air spiral case is expediently delimited in sections by the fuel tank of the internal combustion engine, which thus serves for guiding the air and is cooled by the drawn-in ambient air. Furthermore, for the intake portion of the interior of the housing that is disposed adjacent to the crankcase of the engine, a flow access can be provided in the region of the carburetor of the internal combustion engine in order to there draw in a partial stream of the cooling air that cools the carburetor. Additional components such as walls or the like can be provided in the implement housing and on the engine for guiding the air.

The second inlet openings for conveying cooling air to the second cooling air inlet in the base of the cooling air spiral case can be disposed in a starter cover that accommodates a shaft pin of the crankshaft disposed remote from the driver, and also accommodates a starter mechanism of the internal combustion engine that cooperates with this shaft pin. This counteracts a heating-up of the starter mechanism, for example a rope pull starter for starting the internal combustion engine. By cooling the starter cover and starter handle of the rope pull starter, the temperatures of components that may be touched by an operator are kept low.

Drawing in cooling air in independent partial streams from different directions also has the advantage that the cooling air conveyance is less sensitive to clogging or obstruction of the cooling air inlets with dirt particles from the ambient air.

Further specific features of the present invention will be described in detail subsequently.

DESCRIPTION OF PREFERRED EMBODIMENTS

Referring now to the drawings in detail, the manually guided implement shown in FIG. 1 is a brush cutter 1 for mowing grass or other ground cover. The brush cutter 1 comprises a guide rod 11 on which a steering or handle bar 13 is secured approximately transversely. Formed on the ends of the steering bar 13 are handles 14 that are grasped by an operator 15 for guiding the brush cutter 1. The operator 15 carries the manually guided brush cutter 1 by means of a carrying strap 19.

Disposed at the back end of the guide rod 11 is a drive unit 12 that includes an implement housing 3 in which is accommodated an internal combustion engine. The guide rod 11 is embodied as a tube and accommodates a drive shaft (FIG. 2) by means of which the internal combustion engine drives a rotating tool that can be guided at the front end of the guide rod 11. In the illustrated embodiment, the rotating tool is a cutter blade 10 that can be driven by a miter gear 18 and can be guided back and forth over the surface that is to be mowed in the direction of the arrow 17.

Figure 2:
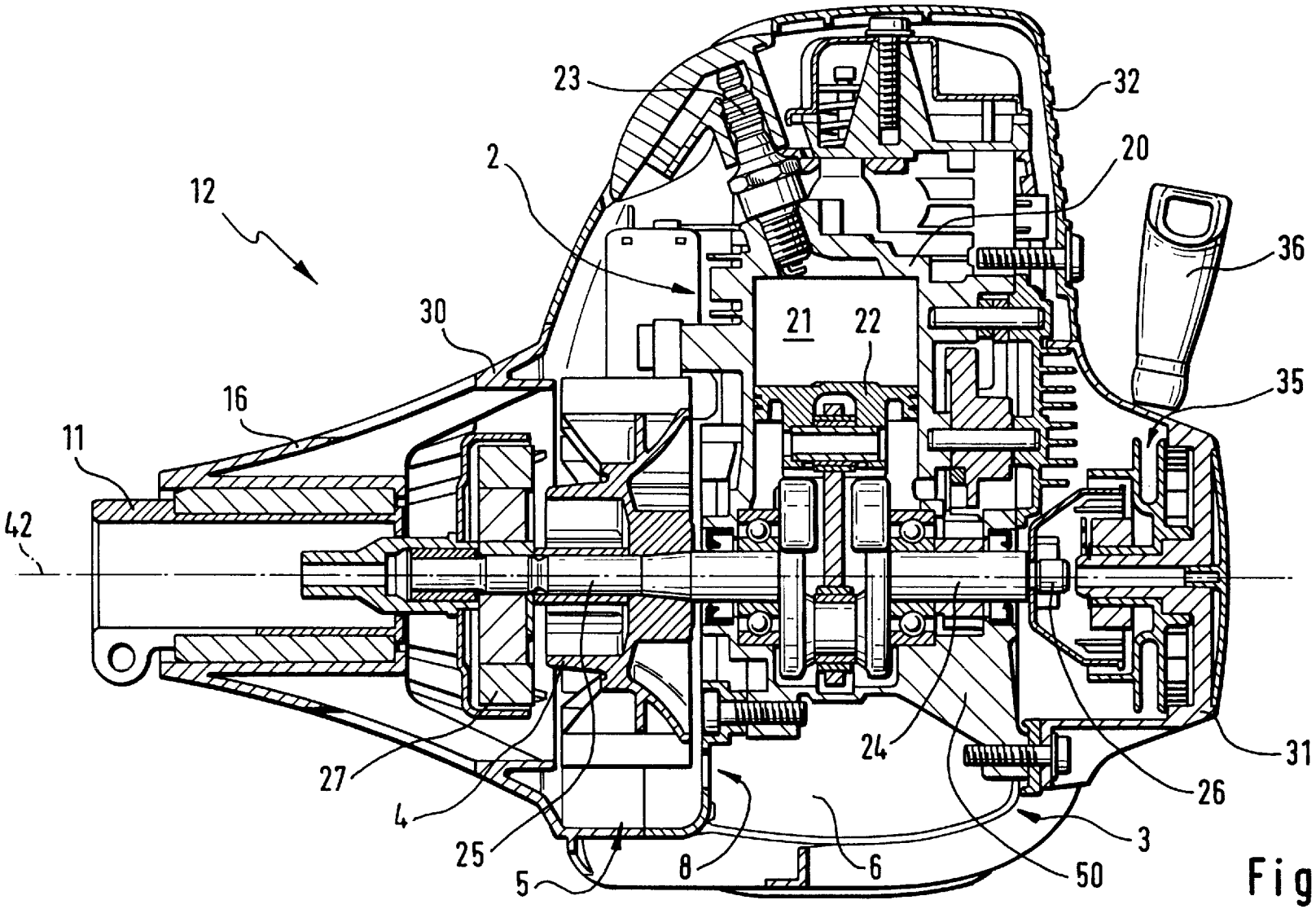
FIG. 2 is a cross-sectional view through the drive unit of a brush cutter.

FIG. 2 shows a longitudinal cross-sectional view through the drive unit 12, which is disposed at the back end of the guide rod of the brush cutter. Disposed in the implement housing 3 of the implement is an internal combustion engine 2, which in the illustrated embodiment is an air-cooled four-stroke engine, but can also be a two-stroke engine. The single cylinder four-stroke engine 2 includes, in a customary manner, a cylinder 21 in which a reciprocating piston 22 is longitudinally moveable and rotatingly drives a crankshaft 24 by means of a crank drive. The crankshaft and the rotating components of the crank drive are disposed in a crankcase 50, which adjoins the cylinder 21. On the upper side of the cylinder 21, opposite the crankcase 50, a cylinder head 20 closes off the combustion chamber, whereby an ignition or spark plug 23 is accommodated in the cylinder head 20 for mixture ignition.

The internal combustion engine 2, by means of its crankshaft 24, drives the tool of the brush cutter, whereby a drive shaft 16 that leads to the tool is accommodated in the tubular guide rod 11. For the sake of simplicity, only the connector of the drive shaft 16 is shown in the drawing. The rotational movement of the crankshaft 24 about the axis of rotation 42 is transmitted to the drive shaft 16 via a centrifugal clutch 27. The centrifugal bodies of the clutch 27 are taken along by the driver 25 of the crankshaft 24, and when the engine speed is sufficient these bodies come into engagement with a coupling cage that extends over the centrifugal bodies and is fixedly connected with the drive shaft 16 in the guide rod 11.

A crankshaft pin of the crankshaft 24 projects from both sides of the crankcase 50. The shaft pin 26, which projects from the crankcase 50 on the rear side opposite the drive side of the internal combustion engine 2, cooperates with a starter mechanism 35 to start the implement. In the illustrated embodiment, the starter mechanism is a rope pull starter 35, whereby a rope pulley is accommodated in a pot-shaped starter cover 31 that is secured to the housing 3 of the drive unit 12. By pulling the handle 36, the rope of the starter 35 can be unwound from the rope pulley, thereby rotating the shaft pin 26.

During operation of the implement, the four-stroke engine 2 is cooled with cooling air that is drawn in by a fan wheel 4. This fan wheel is fixedly held on the driver 25 of the crankshaft, and is disposed between the clutch 27 and the crankcase 50. The fan wheel 4 is accommodated in a cooling air spiral case 5, which is open toward the internal combustion engine 2. From FIG. 3, it can be seen that the cooling air spiral case 5 has a cup-shaped configuration with a base 7 that is embodied radially relative to the axis of rotation 42 of the crankcase 24; formed on the edge of the base 7 is a peripheral wall 9 that axially overlaps the fan wheel 4. The cooling air stream to the engine 2 is guided along the peripheral wall 9. At the end of the peripheral wall 9, the cooling air stream leaves the cooling air spiral case 5 and is blown or discharged against the cylinder head 20 of the engine 2 in the region of the spark plug 23. The cooling air flows about the cylinder head 20, which is covered by a hood of the housing, and leaves the implement housing 3 via an outlet grating 32 of the hood, which is disposed adjacent to the starter cover 31 on the backside of the drive unit 12.

A first air inlet into the cooling air spiral case 5 is formed by a fan cover 30, which overlaps that end face of the spiral case that is opposite the base 7, and is held on the implement housing 3. The fan cover 30 is embodied in the shape of a pot that widens in a funnel-like manner, and accommodates the centrifugal clutch 27. The front, tapered end of the fan cover 30 is disposed against the guide rod 11. Formed on the periphery of the fan cover 30 are opening slots 33 (see FIG. 5) through which the fan wheel 4 draws in air surrounding the drive unit 12 into the cooling air spiral case 5. The opening slots 33 are disposed approximately at the level of the centrifugal clutch 27, which is thus kept cool by the entering first cooling air stream 34 (see FIG. 5).

Figure 3:
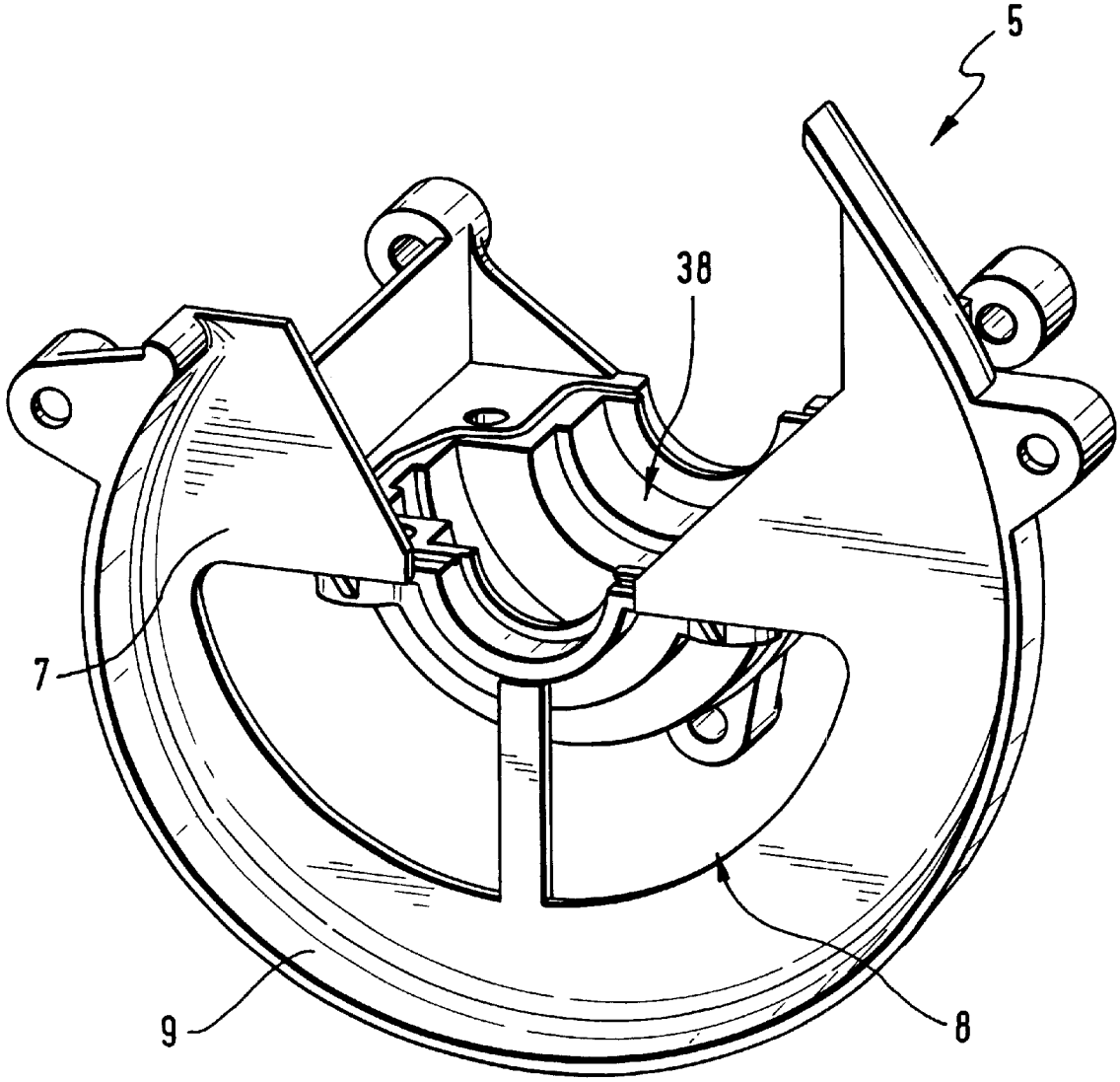
FIG. 3 is a perspective view of a cooling air spiral case.

A second cooling air inlet 8 into the cooling air spiral case 5 is formed in the base 7 thereof, as a result of which two cooling air streams are drawn into the cooling air spiral case 5, independently of one another in axially opposing directions, and are discharged together onto the cylinder head 20. As a consequence of the second air inlet 8 in the base of the cooling air spiral case 5, warm air is withdrawn out of the interior of the implement housing 3. Due to the air movement in the housing resulting from subsequently flowing in air, the components disposed in the housing are cooled. The second cooling air inlet 8 is formed in the base 7 of the cooling air spiral case 5 on that side of the crankshaft 24 disposed opposite the engine. As a result, cooling air is withdrawn from an intake chamber 6 that next to the cooling air spiral case 5 is delimited by the implement housing 3. As shown in FIG. 3, the cooling air inlet 8 in the base 7 of the cooling air spiral case 5 is formed adjacent to the crankshaft bearing 38 and, in the illustrated embodiment, extends over an angle of curvature of about 180°, thereby ensuring an adequate cross-sectional through passage for the second air inlet 8.

Figure 4A:
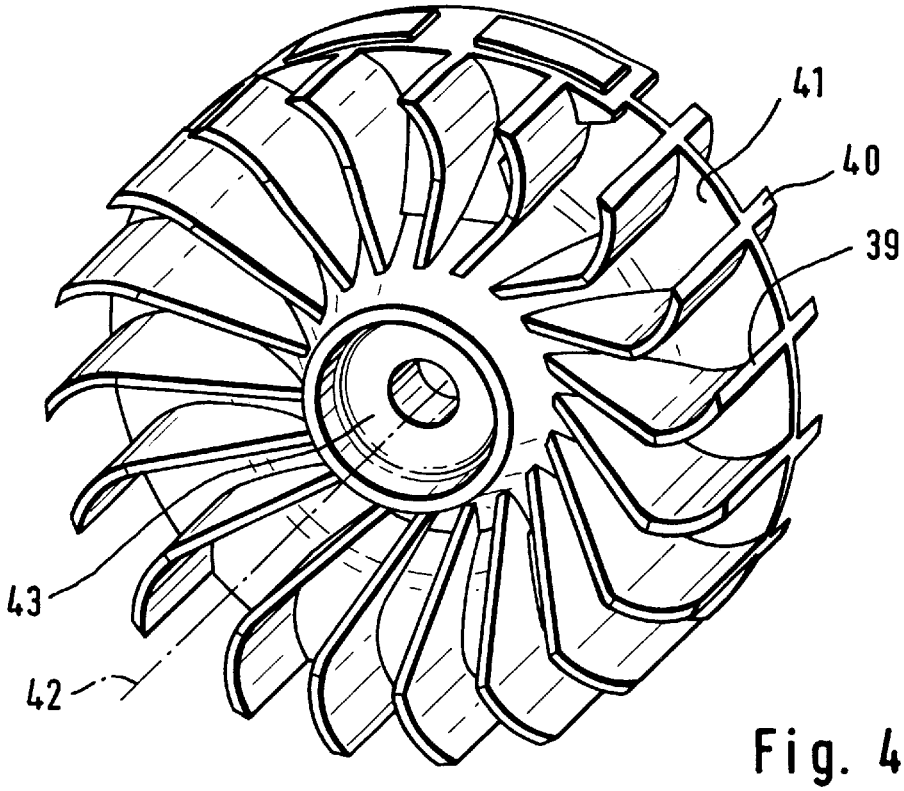
FIGS. 4*a* and 4*b* are perspective views of a fan wheel.
Figure 4B:
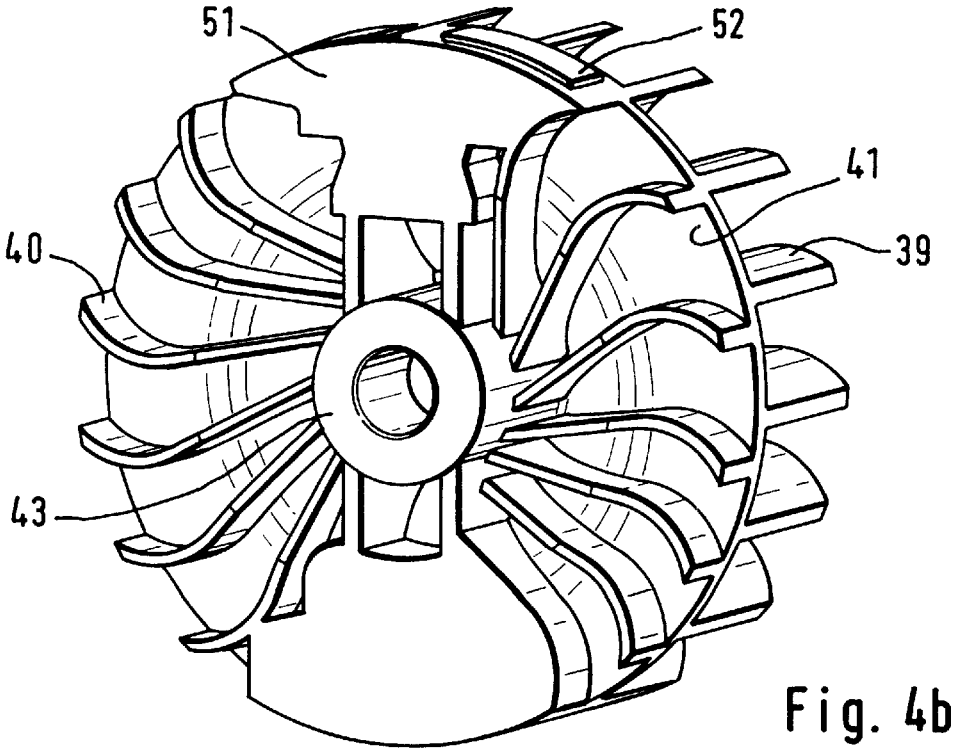

The fan wheel 4, for conveying two cooling air streams, will subsequently be described in greater detail with the aid of the front side pursuant to FIG. 4*a* and pursuant to the rear side pursuant to FIG. 4*b* of that side that faces the base of the cooling air spiral case 5. On both end faces, the fan wheel 4 carries a respective suction ring of vanes 39, 40 that are separated from one another by a radially extending partition 41. The partition 41 extends from a hub 43 to the periphery of the fan wheel, where the vanes of the two suction rings of vanes 39, 40 end. In the illustrated embodiment, in the installed position of the fan wheel 4 for conveying the first cooling stream through the fan cover 30, that suction ring of vanes that is disposed outwardly relative to the internal combustion engine has a larger axial width than does the second suction ring of vanes 40, which is provided for conveying the second cooling air stream through the inlet in the base of the cooling air spiral case 5. A different dimensioning of the rings of vanes can also be expedient, depending upon how the volumes of the conveyed cooling air streams are to be set. In the illustrated embodiment, a greater partial stream of the entire cooling air stream conveyed by the fan wheel is drawn in by the outer ring of vanes from cool ambient air, and an effective cooling of the cylinder head is ensured. The second suction ring of vanes 40 ensures an air movement in the implement housing and prevents an excessive temperature in the region of the crankcase of the engine and of the other components disposed in that portion of the implement housing remote from the cylinder. The fan wheel comprises two diametrically opposed flywheel masses 51 that in the illustrated embodiment are formed in the second suction ring of vanes 40 and in the axial direction of the fan wheel extend beyond the partition 41 into the first suction ring of vanes 41. Set into one of the flywheel masses 51 is an ignition magneto 52 that during operation of the implement cooperates with a magneto ignition unit of the internal combustion engine.

Figure 5:
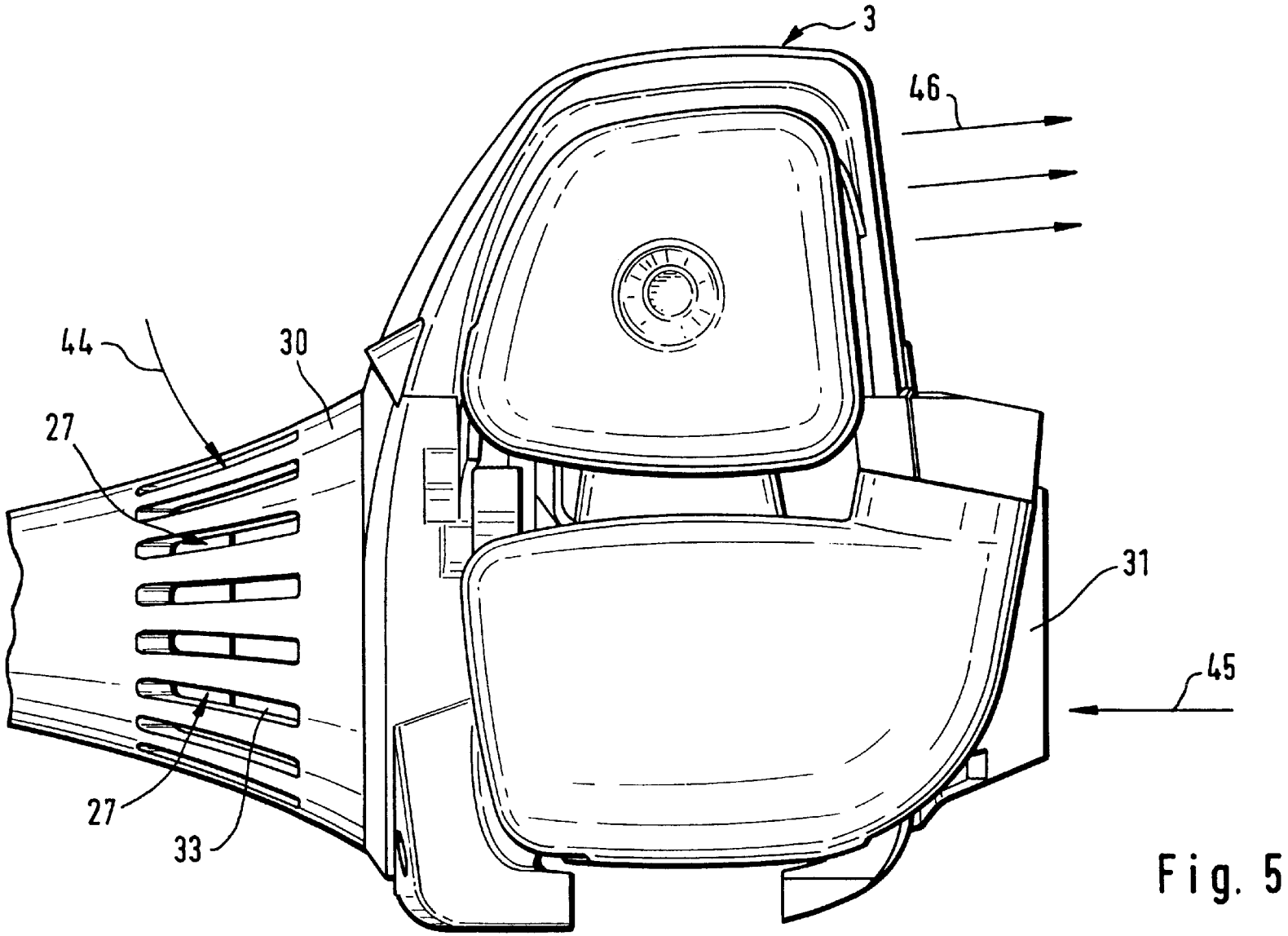
FIG. 5 is a side view of the drive unit.

The intake chamber 6 (FIG. 2), which is associated with the second cooling air inlet 8 of the cooling air spiral case 5, and is formed adjacent to the crankcase 50 of the internal combustion engine 2, is in flow communication with second inlet openings in the implement housing 3 through which air enters the housing and subsequently flows into the intake chamber 6. As shown in FIG. 5, the cooling air 45 that subsequently flows into the intake chamber is conveyed to the drive unit on that side disposed opposite the fan cover 30. The fan wheel thus draws the first cooling air stream 44 onto the front side of the implement housing 30 through the fan cover 30, and on the opposite side draws in the second cooling air stream 45, so that independently of one another cooling air from the air surrounding the implement housing 3 is drawn in and guided to the internal combustion engine. In this way, the danger of an obstruction of the air intake of the implement due to dirt particles is reduced by two separate flow paths. The inlet openings for the second cooling air inlet are formed in the starter cover in the illustrated embodiment, whereby large cross-sectional inlet areas are achieved that effect a reduction of the flow velocity of the in-flowing cooling air. This counteracts any obstruction of the inlet openings.

Figure 6:
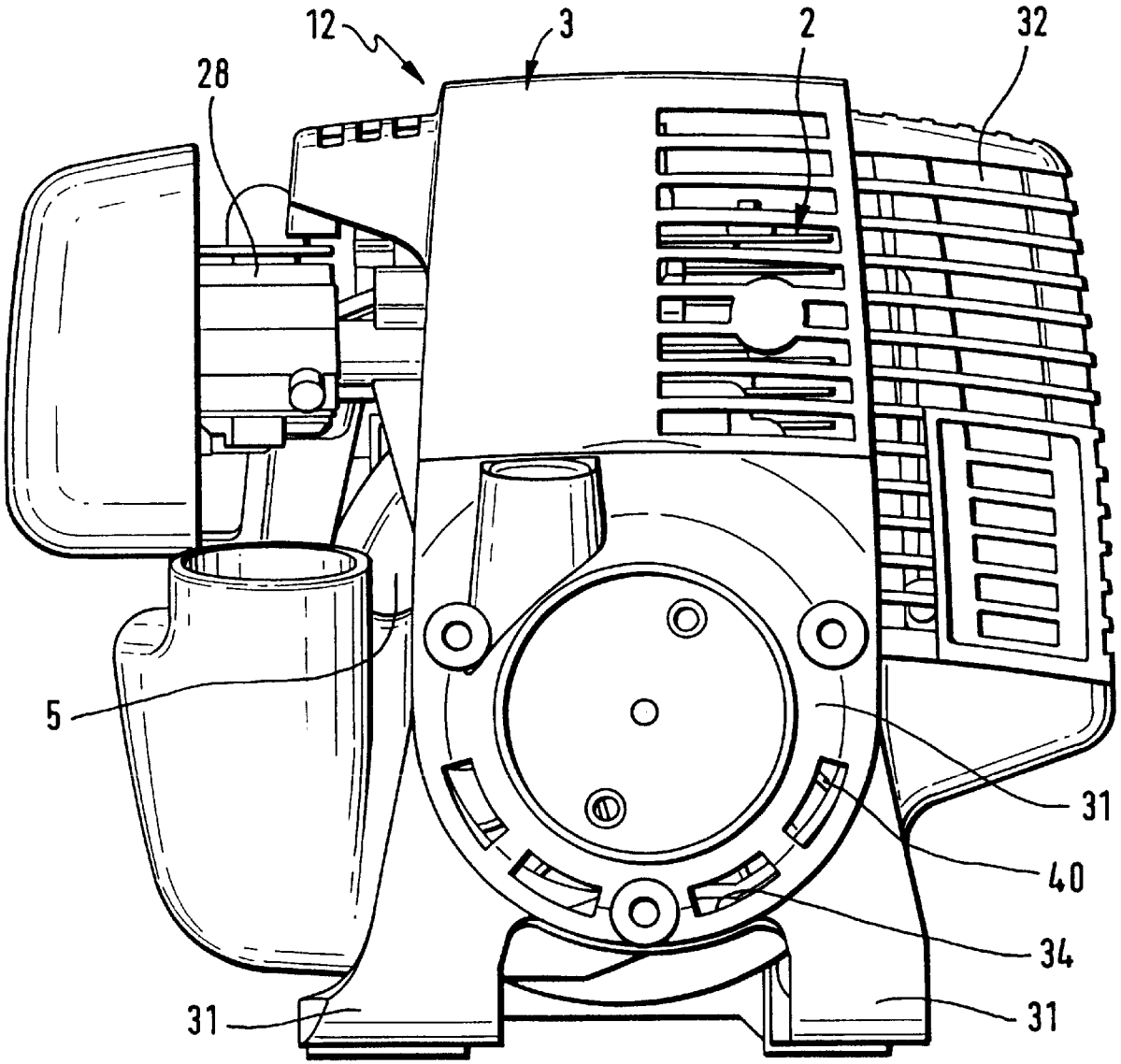
FIG. 6 is a view of the rear side of the drive unit.
Figure 8:
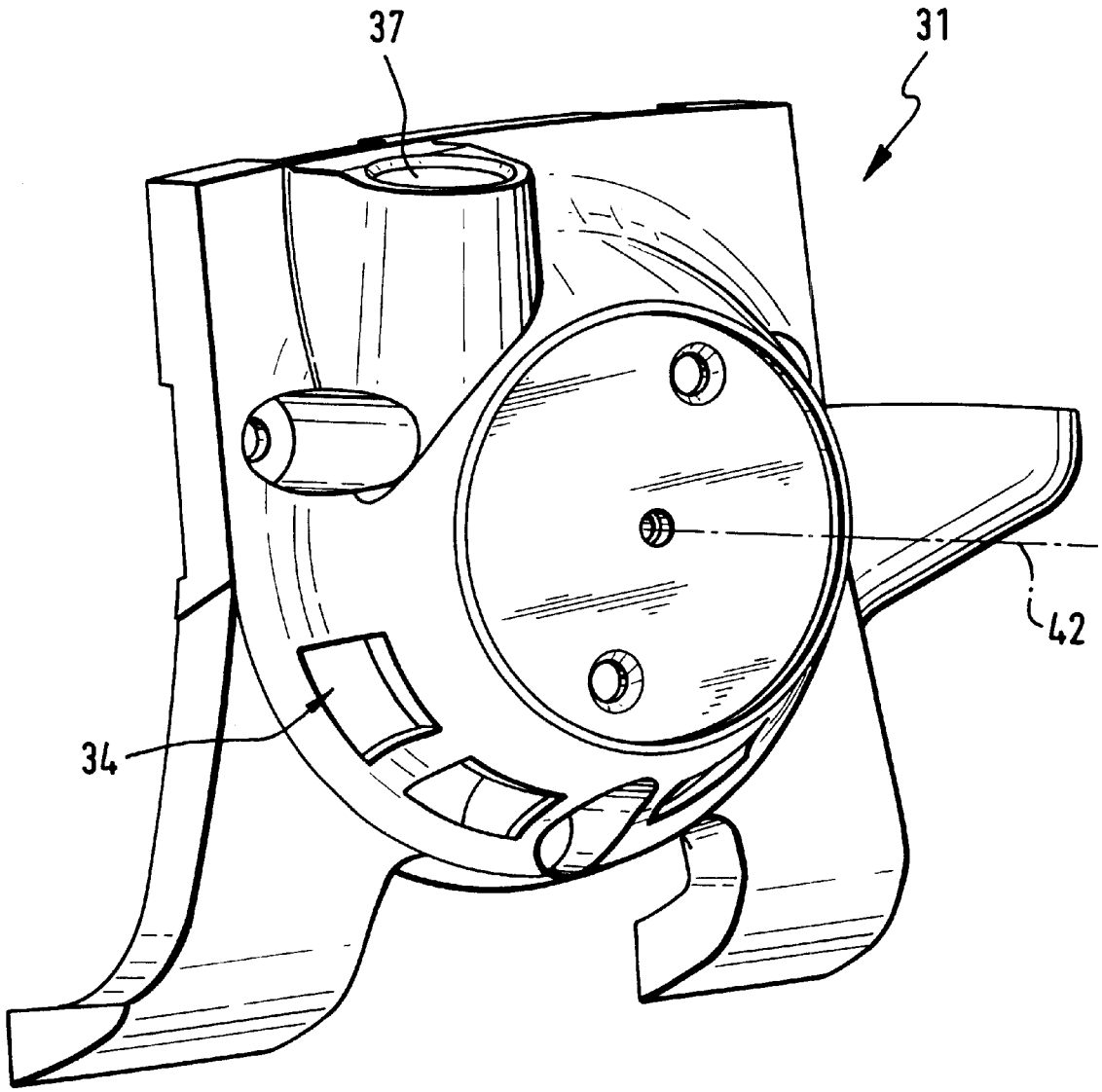
FIG. 8 is a perspective view of the starter cover.

FIG. 6 shows a plan view of the rear side of the drive unit, where the starter cover 31 is disposed on the housing 3 and the outlet grating 32 for the cooling air exiting the internal combustion engine 2 is formed. Disposed in the starter cover 31, which is illustrated in perspective as a separate component in FIG. 8, are the inlet openings 34 that in the peripheral direction are disposed on that side of the axis of rotation 42 of the crankshaft that is opposite the internal combustion engine, so that a short flow path is provided to the intake chamber below the crankcase, from which the second cooling air stream is drawn. The inlet openings 34 are formed on a cup-shaped bulge of the starter cover 31 that accommodates the rope pulley of the rope pull starter mechanism. The rope of the starter is unwound from the rope pulley 37 by means of the handle, which is not illustrated in this view, and the engine is started.

The intake chamber for the second cooling air stream is formed in the starter cover 31 between the cooling air spiral case 5 and the inlet openings 34. As can be seen in FIG. 6, the base of the cooling air spiral case 5 is visible through the inlet openings 34, and by means of the cooling air inlet in the base of the cooling air spiral case a direct flow path is provided to the second suction ring of vanes 40 of the fan wheel 4.

Figure 7:
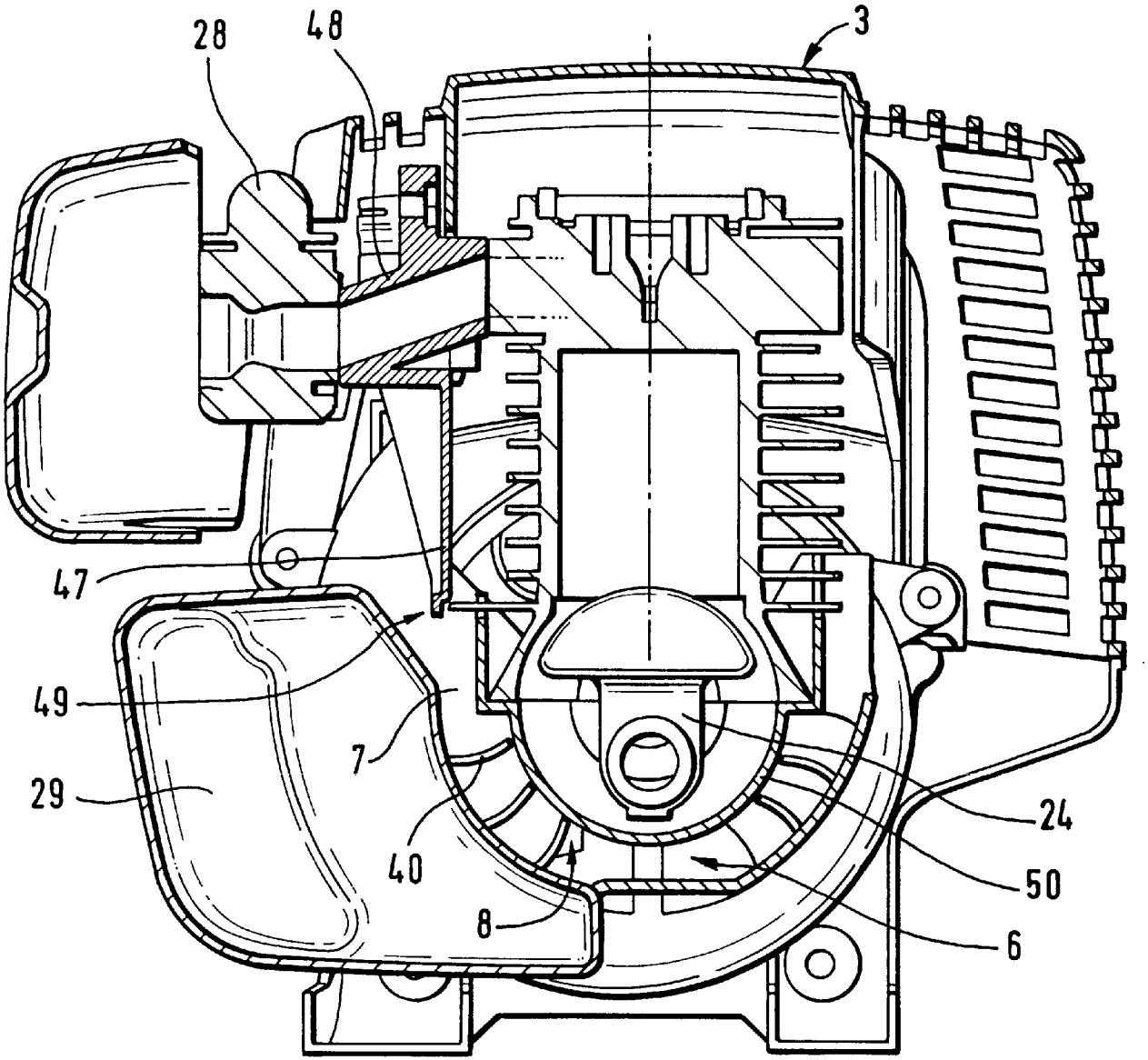
FIG. 7 is a cross-sectional view of the drive unit.

FIG. 7 shows a cross-sectional view of the drive unit at the level of the intake chamber 6 next to the crankcase 50 of the internal combustion engine. The inventive conveyance of a second cooling air stream through the cooling air inlet 8 in the base 7 of the cooling air spiral case 5 enables an efficient cooling of further components and devices of the internal combustion engine accommodated in the implement housing due to the fact that the flow path of drawn-in cooling air is disposed in the intake chamber 6 along the components that are to be cooled. In the illustrated embodiment, in addition to the axial flowing-in into the intake chamber 6 through the inlet openings in the starter cover, a flow entry 49 is provided adjacent to a carburetor 28 of the internal combustion engine. The flow entry 49 is formed between the carburetor 28 and a fuel tank 29, so that not only the carburetor 28 but also the fuel tank 29 are cooled off by the additionally drawn-in cooling air stream. The flow entry 49 is separated by a fire wall 47 from the cylinder of the internal combustion engine, so that the suction ring of vanes 40 of the fan wheel, in addition to the cooling air drawn in through the starter cover, also draws in air via the flow entry 49 in the region of the fuel tank 29 and the carburetor 28. In the illustrated embodiment, the fire wall 47 is formed on a carburetor flange 48 that connects the carburetor 28 with the mixture inlet of the internal combustion engine. Due to the cooling of the fuel tank 29, the internal pressure of the tank is lowered, so that when the tank lid is opened no sudden pressure equalization, with the drawbacks connected therewith, occurs. In favorable situations, it can even be possible to eliminate a venting valve.

In a compact construction of the drive unit, the fuel tank 29 with the inventive cooling can be disposed adjacent to the crankcase. Due to the flow entry 49, hot air is drawn out of the region of the carburetor 28 and is mixed with the cooling air stream in the cooling air spiral case, so that the operating temperatures of the carburetor are reduced.

The specification incorporates by reference the disclosure of German priority document 100 21 707.9 of May 4, 2000.

The present invention is, of course, in no way restricted to the specific disclosure of the specification and drawings, but also encompasses any modifications within the scope of the appended claims.

What we claim is:

1. A manually guided implement having an air-cooled internal combustion engine for driving a tool, said implement comprising:

an implement housing in which said internal combustion engine is disposed, wherein said housing has a first air inlet;

a cooling air spiral case disposed in said implement housing and open toward said internal combustion engine, wherein ambient air can be drawn into said cooling air spiral case via said first air inlet for conveyance to said internal combustion engine; and a fan wheel fixedly held on a crankshaft of said internal combustion engine and accommodated in said cooling air spiral case, wherein a second air inlet is formed as an aperture in a wall of said cooling air spiral case, in said housing, wherein said second air inlet provides communication between an intake chamber of said implement housing and portions of said cooling air spiral case that convey cooling air.

2. An implement according to claim 1, wherein said second air inlet is disposed on a side of said crankshaft that is remote from a cylinder of said internal combustion engine.

3. A manually guided implement having an air-cooled internal combustion engine for driving a tool, said implement comprising:

an implement housing in which said internal combustion engine is disposed, wherein said housing has a first air inlet;

a cooling air spiral case disposed in said implement housing and open toward said internal combustion engine, wherein ambient air can be drawn into said cooling air spiral case via said first air inlet for conveyance to said internal combustion engine; and a fan wheel fixedly held on a crankshaft of said internal combustion engine and accommodated in said cooling air spiral case, wherein a second air inlet is formed in a base of said cooling air spiral case that is disposed between said fan wheel and said internal combustion engine, wherein said second air inlet provides communication between an intake chamber of said implement housing and portions of said cooling air spiral case that convey cooling air, and wherein said fan wheel has two end faces, each of which is provided with a respective suction ring of vanes.

4. An implement according to claim 3, wherein said fan wheel is provided with a radially extending partition that separates said suction rings of vanes.

5. An implement according to claim 4, wherein an outwardly disposed first one of said suction rings of vanes as viewed relative to said internal combustion engine, has a greater axial width than does the other inwardly disposed one of said suction rings of vanes.

6. An implement according to claim 1, wherein said fan wheel is disposed on a driver of said crankshaft that drives said tool.

7. An implement according to claim 1, wherein a fan cover is held on said implement housing and covers said cooling air spiral case wherein said first air inlet, as a plurality of inlet openings, are provided in said fan cover for air intake.

8. An implement according to claim 7, wherein said fan cover has a pot-shaped configuration and accommodates therein a clutch that cooperates with said crankshaft, wherein said first inlet openings are disposed on a periphery of said fan cover at the level of said clutch.

9. A manually guided implement having an air-cooled internal combustion engine for driving a tool, said implement comprising:

an implement housing in which said internal combustion engine is disposed, wherein said housing has a first air inlet;

a cooling air spiral case disposed in said implement housing and open toward said internal combustion engine, wherein ambient air can be drawn into said cooling air spiral case via said first air inlet for conveyance to said internal combustion engine; and a fan wheel fixedly held on a crankshaft of said internal combustion engine and accommodated in said cooling air spiral case, wherein a second air inlet is formed in a base of said cooling air spiral case that is disposed between said fan wheel and said internal combustion engine, wherein said second air inlet provides communication between an intake chamber of said implement housing and portions of said cooling air spiral case that convey cooling air wherein said intake chamber of said implement housing is disposed between a crankcase of said internal combustion engine and said housing, and wherein said intake chamber is in flow communication with at least one third inlet opening provided in said housing.

10. An implement according to claim 9, wherein said at least one third inlet opening is disposed on a side of said internal combustion engine that is remote from said cooling air spiral case.

11. An implement according to claim 10, wherein a starter cover is disposed on said implement housing, wherein said at least one third inlet opening is disposed in said starter cover, and wherein said starter cover accommodates a shaft pin of said crankshaft that is disposed opposite a driver thereof and also accommodates a starter mechanism for starting said internal combustion engine, that cooperates with said shaft pin.

12. A manually guided implement having an air-cooled internal combustion engine for driving a tool, said implement comprising:

an implement housing in which said internal combustion engine is disposed, wherein said housing has a first air inlet;

a cooling air spiral case disposed in said implement housing and open toward said internal combustion engine, wherein ambient air can be drawn into said cooling air spiral case via said first air inlet for conveyance to said internal combustion engine; and a fan wheel fixedly held on a crankshaft of said internal combustion engine and accommodated in said coating air spiral case, wherein a second air inlet is formed in a base of said cooling air spiral case that is disposed between said fan wheel and said internal combustion engine, wherein said second air inlet provides communication between an intake chamber of said implement housing and portions of said cooling air spiral case that convey cooling air, and wherein a flow path within said implement housing to said second air inlet in said base of said cooling air spiral case is delimited in stages by a fuel tank of said internal combustion engine.

13. An implement according to claim 9, wherein in the vicinity of a carburetor of said internal combustion engine, a flow access is provided to said intake chamber in said implement housing.

14. An implement according to claim 1, wherein said internal combustion engine is a four-stroke engine.

* * * * *